US005870917A

United States Patent [19]

Mahot et al.

[11] Patent Number: 5,870,917

[45] Date of Patent: Feb. 16, 1999

[54] KEY PROVIDED WITH A STATUS DISPLAY

[75] Inventors: Philippe Mahot, Monaco, Monaco; Jean-Claude Mimran, Gstaad, Switzerland

[73] Assignee: Tasky Anstalt, Vaduz, Liechtenstein

[21] Appl. No.: 951,306

[22] Filed: Oct. 16, 1997

[30] Foreign Application Priority Data

Oct. 22, 1996 [CH] Switzerland ..... 2582/96

[51] Int. Cl.[6] ..... E05B 19/04

[52] U.S. Cl. ..... 70/408; 70/395; 70/432; 40/330

[58] Field of Search ..... 70/395, 408, 432, 70/436, 438; 40/330, 506, 634

[56] References Cited

U.S. PATENT DOCUMENTS

| | | | |
|---|---|---|---|
| 1,843,335 | 2/1932 | Oberfield | 70/432 |
| 2,176,465 | 10/1939 | Merkl . | |
| 2,198,484 | 4/1940 | Merkl . | |
| 4,432,218 | 2/1984 | Hoener . | |
| 4,440,011 | 4/1984 | Klein | 70/432 |
| 4,631,943 | 12/1986 | Hoener | 70/432 |
| 5,435,160 | 7/1995 | Linsalato et al. | 70/432 |

FOREIGN PATENT DOCUMENTS

| | | |
|---|---|---|
| 0 127 113 | 12/1984 | European Pat. Off. . |
| 16 690 | 6/1881 | Germany . |
| 26 34 969 | 2/1978 | Germany . |
| 31 43 495 | 5/1983 | Germany . |
| 31 48 542 | 6/1983 | Germany . |
| 32 42 766 | 5/1984 | Germany . |
| 34 07 034 | 9/1985 | Germany . |
| 85 07 137 | 10/1985 | Germany . |
| 35 03 671 | 8/1986 | Germany . |
| 32 07 998 | 8/1987 | Germany . |
| 7-217272 | 8/1995 | Japan . |
| 7-269187 | 10/1995 | Japan . |
| 236 199 | 6/1945 | Switzerland . |
| 385 660 | 3/1965 | Switzerland . |
| 184763 | 2/1923 | United Kingdom . |

*Primary Examiner*—Suzanne Dino Barrett
*Assistant Examiner*—Stephen L. Grady
*Attorney, Agent, or Firm*—Young & Thompson

[57] ABSTRACT

The key has a head (2) provided with a window (3) enabling to see a portion (5) of the surface of the cylinder of the body (4) of the key. Two grooves (16) extend each one over one half of the circumference of the body (4), they are mutually offset by 180 degrees and ended by bores (7). In the service position, pins (12) are urged towards the bottom of the bores (7) by a resilient member (13). When the torque applied to the head (2) of the key increases, the pins (12) are expelled from the bores (7) and the head of the key can rotate by 180 degrees relatively to its shank (1), thus showing the opposite portion of the body (4) through the window (3).

8 Claims, 2 Drawing Sheets

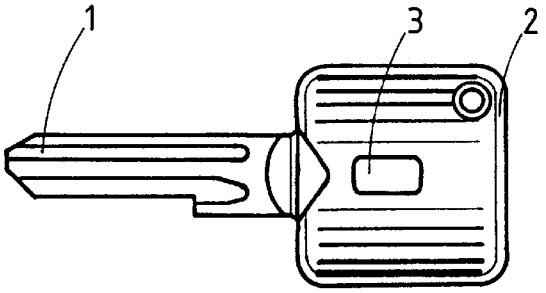
FIG. 1
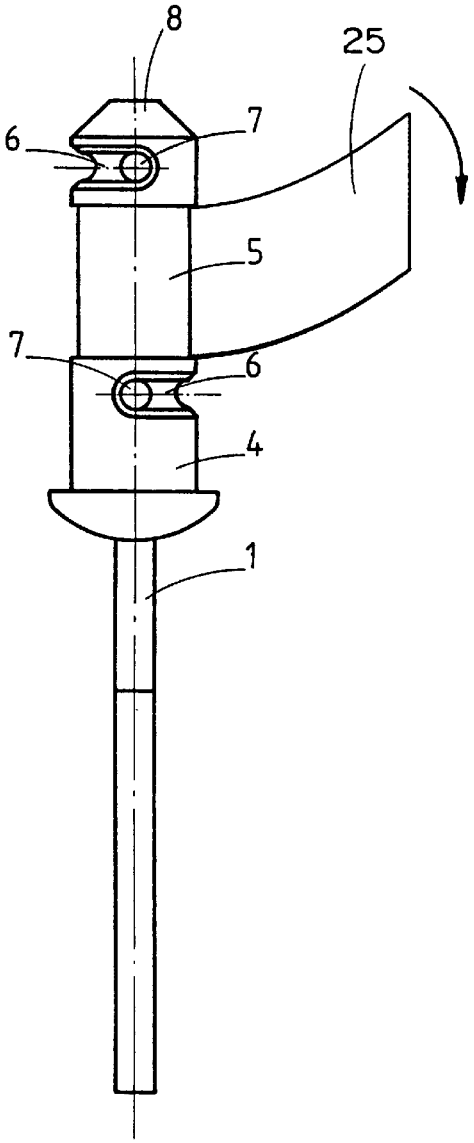
FIG. 2
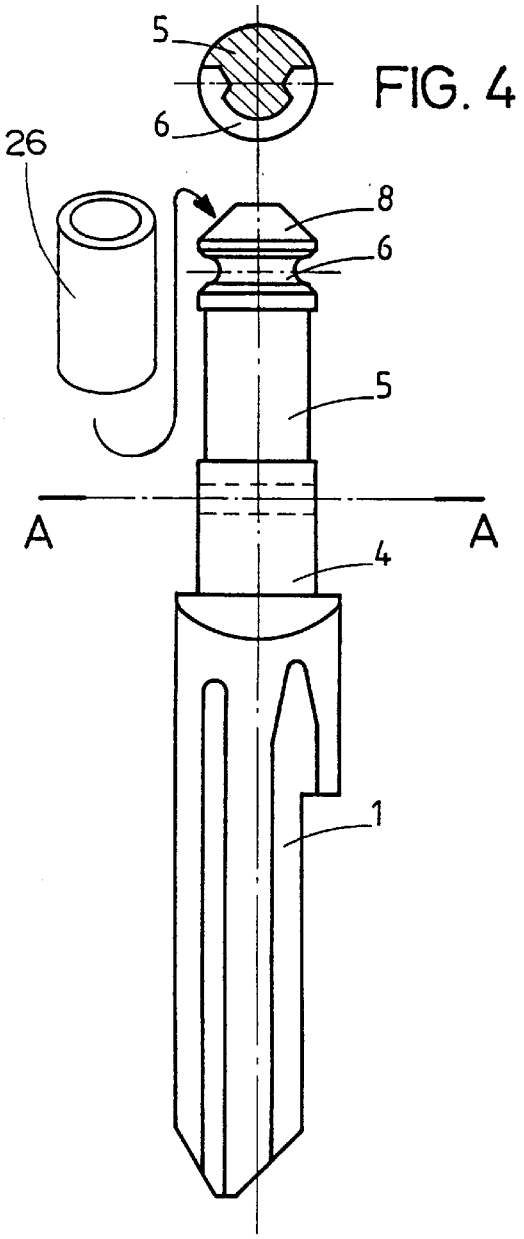
FIG. 4
FIG. 3

KEY PROVIDED WITH A STATUS DISPLAY

BACKGROUND OF THE INVENTION

The present invention is concerned with a key and, more particularly, with a key comprising means enabling to see the last status, open or closed, of the corresponding locks.

DESCRIPTION OF THE RELATED ART

Locks are known, which are provided with a visible marking which can assume two different states, depending on the open or closed status of the lock. This however requires that the user be near the lock to recognize its status. To solve the problem of verifying remotely the status of a lock, the German patent DE 3207998 C2 proposes a key, the head of which is provided with an electrical circuit having a pulse generator and with a source of energy supplying an optical display. When the key is introduced completely into the cylinder, a pressure contact activates the electric circuit. The rotation of the key initiates the displacement of a movable contact by the effect of gravity, and a pulse is generated modifying the status of the optical display. This device makes it possible to solve the above-mentioned problem, but is expensive and complicated to manufacture. Furthermore, this device necessitates a source of energy in the head of the key, for example in the form of a battery and, accordingly, poses problems of reliability when the battery is discharged.

SUMMARY OF THE INVENTION

The purpose of the present invention is to remedy to the above-mentioned drawbacks and to provide a device which is simple to manufacture, which requires no source of energy and which enables the owner of a key to determine, by direct reading of the latter, the last status of the corresponding lock. Furthermore, the device should be inexpensive and capable of adaptation to different types of existing keys. This objective is attained by a key which is characterized by the features set forth in claim 1.

BRIEF DESCRIPTION OF THE DRAWINGS

The invention will now be described with reference to the annexed drawing which represents schematically a non limiting example of an embodiment of the key according to the present invention, wherein:

FIG. 1 is a bottom view of the assembled key according to the present invention.

FIG. 2 is a profile view of the body of the key.

FIG. 3 is a front view of the body of the key illustrated in FIG. 2.

FIG. 4 is a cross-sectional view taken along line A—A of the body of the key illustrated in FIG. 3.

DESCRIPTION OF THE PREFERRED EMBODIMENTS

Figure 5:
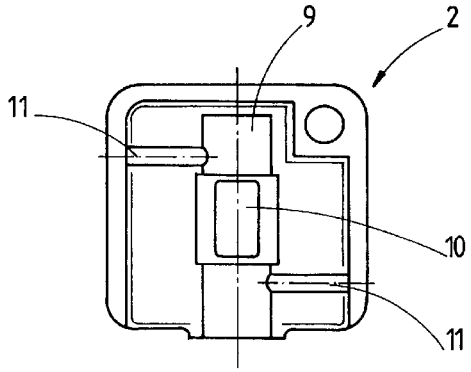
FIG. 5 is a front view of one half of the piece forming the head of the key.

With reference to FIG. 1, the key is conformed in a traditional manner in its upper head part 2 and in its lower shank part 1, designed for introduction into the cylinder of the corresponding lock. An opening or window 3 is provided at the center of the head 2 of the key. This transparent window 3 enables a visual determination of the last status of the lock. Thus, a red color will appear, for example, in this window 3 when the corresponding lock is in the closed position and a green color when the same is in the open position. It is obvious that the choice of the colors is arbitrary and can be adapted according to the wishes of the user.

FIG. 2 illustrates the body of the key, of which the upper part is designed for receiving the head 2 which will be described in detail with reference to FIGS. 5 to 8. The lower part 1 of the key provides the shank which can be machined according to the cylinder of the lock for which it is intended. The upper part of the body of the key is comprised of a cylindrical portion 4 of which the central part has a diameter which is slightly smaller. This central part 5 is designed for receiving the information support, which is provided as a self-adhesive rectangular strip 25 of a length corresponding to the circumference of the central part 5. The self-adhesive strip 25 is applied to central part 5 as indicated by the curved arrow of FIG. 2. This self-adhesive strip 25 has one color on one half of its length another color on the other half of its length, this other being selected to allow a discrimination between the two statuses of the lock. When the colored strip is placed on the central part 5, the first covers one half of the circumference of the part 5 over its whole length, the other half being colored by the second color selected. One can also consider the use of a bushing 26 colored with two colors, each color covering over the whole length of the bushing 26 one half of the circumference. This bushing, designed for being slipped over, and to adhere to, the central part 5 of the body of the key, as indicated by the arrow of FIG. 3, is generally made of a plastic material or of polycarbonate. Alternatively, central part 5 may serve as the bushing 26, wherein the central part 5 is colored in printing or the central part can be made of two halves, differently colored.

The upper part of the body has two grooves 6, extending each one over one half of the circumference of the body 4. The upper and lower grooves 6 are mutually offset by 180 degrees, so that they extend each one over an opposite half of the circumference of the body 4. On the axis of symmetry of the body, the grooves 6 end by a bore 7 of which the depth is slightly greater than that of the grooves 6. The body 4 is ended in its upper part by a frustoconical portion 8.

FIG. 3 is a frontal view of the body of the key represented in profile in FIG. 2 and it shows over which portions of the circumference of the cylinder the grooves 6 extend. The cross-sectional view of FIG. 4 shows the depth of the bores 7.

FIG. 5 shows one half of the piece forming the head 2 of the key. This piece is generally made of a plastic material, by molding or injection. This piece illustrated as having a rectangular shape, can obviously be conformed differently according to the visual effect desired and can be, in non-limiting exemplary embodiments, oval or round shaped. The central part of this piece includes a longitudinal semi-cylindrical recess 9, designed for receiving the upper part 4 of the body of the key. One of the two halves of the head of the key has a central rectangular recess 10 providing the display window. This window can be provided with a panel (not illustrated), made of a transparent material. In another version, each one of the two halves of the head of the key will include a display window. When the head of the key includes a display window on each one of its faces, it is necessary that the two windows be offset along the longitudinal axis. In this embodiment, the central part 5 of the cylinder 4 carrying the visual information is separated into two zones. A first zone, facing the first window, has two colors, each one extending over one half of the circumference of the cylinder. A second zone, facing the second display window, also has two colors, each one extending over one half of the circumference. The portions of the circumference of the cylinder 5 carrying the same color are mutually offset by 180 degrees. Accordingly, the same color appears at the same time through each one of the two windows, whatever may be the position of the head of the key relative to its shank.

Two recesses 11, perpendicular to the axis of symmetry of the piece open into the central recess 9. When the head is positioned on the body 4 of the key, the recesses 11 face the grooves 6 of the body 4. These recesses 11 receive, as shown from FIGS. 6 and 7, a friction device comprised of pins 12 and of springs 13. In the service position, i.e. when the head of the key is aligned with the shank, the pins 12 are maintained by the action of the springs 13 at the bottom of the bores 7 of the grooves 6. To simplify the manufacture of the head of the key, the recesses 11 can extend over the whole width of the key and not only over one half thereof as illustrated in the drawings.

Figure 6:
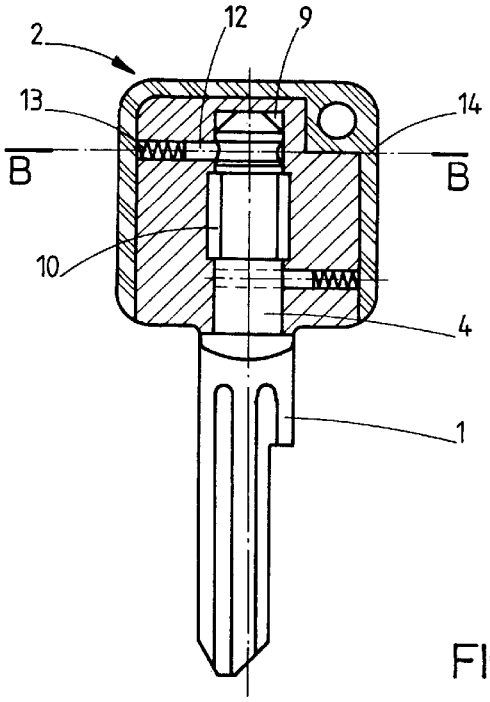
FIG. 6 is a partially cross-sectional view of the key once assembled.
Figure 7:
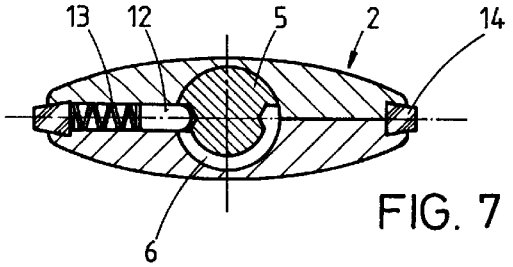
FIG. 7 is a cross-sectional view taken along line B—B of the key shown in FIG. 6.

The assembling of the key, according to the present invention, is extremely simple. In the first step, the two halves constituting the head of the key are superimposed and then bonded together with an adhesive or by hot soldering. The body 4 of the key is then inserted fully into the head of the key in such a manner as to leave solely the shank 1 protruding. The pin 12 and the spring 13 are then inserted into the upper housing 11, and a slight pressure is applied on the spring 13 by means of an appropriate tool, so as to insert the same completely into the body of the head of the key. A rider or a blocking clip 14 is introduced into the trapezoidal groove formed by the two halves of the head of the key. After rotating the key, the first friction device being maintained by the clip 14, the same procedure is applied to place a friction device 12, 13 into the lower housing. The clip 14 can then be pushed into its final position on the head of the key, as illustrated in FIG. 6. This assembling process offers the advantage that it can be completely automated without requiring any complicated assembly line. Another advantage is that the clip 14 is simply urged into the trapezoidal groove, the shape of the latter preventing the clip from escaping. The clip 14 being removable, it is possible, if necessary, to change the springs 13 and replace them by springs exhibiting other characteristics, should one wish to modify the torque which needs to be applied to disengage the pins 12 from the bores 7.

The blocking clip 14 is generally made of a plastic material, preferably colored in its mass, the coloring making it possible to identify individual keys in a set of otherwise identical keys.

Figure 8:
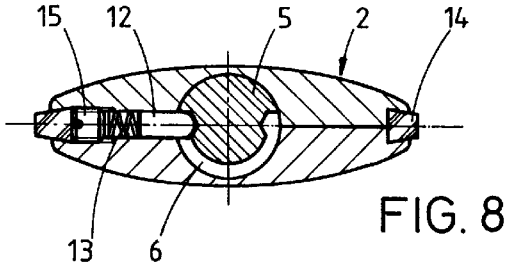
FIG. 8 is a cross-sectional view identical to that of FIG. 7, but showing another version of the head of the key.

In another version and as illustrated in FIG. 8, the recesses 11 exhibit, at their distal end, a bore of smaller diameter provided with a threading. A screw 15 makes it possible to retain the spring 13 and the pin 12 in their housing. This embodiment makes it possible to adjust manually, the pressure of the pins against the grooves and, accordingly, the torque needed to disengage the pins from the bores. Accordingly, the user can adjust himself this parameter, according to the state of the lock.

Once assembled, the head of the key can undergo a 180 degree rotation relative to the body of the key, in one direction or the other. This rotation is limited by the fact that the grooves 6 extend only over one half of the circumference of the body 4. In the service position, the head of the key is maintained aligned with the shank of the key by virtue of the springs 13 urging the pins 12 into the bottoms of the bores 7 located at the ends of the grooves 6. After introduction of the key into the cylinder of the lock, the user imparts a rotation to the key in one direction or the other, depending on whether he wants to open or close the lock. The head of the key is initially fixed with respect to the body of the key, since the lock offers only little resistance until when the bolt is driven. As soon as the torque applied to the head of the key increases, the pins 12 disengage from the bores 7 and the head of the key rotates by one half of a circle relative to the body of the key, displacing thereby the display window 3 to face the opposite portion of the cylinder 5. Accordingly, the other color chosen for identifying the open or closed status appears in the window 3. After having carried out this rotation of one half of a circle, the head of the key is anew aligned with the shank and fixed with respect to the same, and the pins 12 become engaged again in the bores 7. The continued rotation of the head of the key, produces an actuation of the lock. One should note that the springs 13 are sized so that the torque to be applied to the head of the key be lesser than the one necessary for opening or closing the lock. In this manner, the user is certain that he will not be able to open or close the lock without carrying out beforehand a rotation of one half of a circle of the head of the key with respect to the shank. In the position where the head of the key is aligned with the shank, i.e. when the pins 12 are engaged in the bores 7, the user can realign the barrel of the lock to remove the key for example, without any rotation of the head, the torque needed for realigning the barrel being insufficient for causing the disengagement of the pins 12.

The key, according to the invention, is therefore extremely reliable, a change in the status of the display occurring only as a result of an actual operation of opening or closing of the lock. One can note that the friction device, comprised of the pins 12 and of the springs 13, makes it possible, by cooperating with the grooves 6 and the bores 7, on the one hand, to adjust the torque needed for the rotation of the key relative to its shank and, on the other hand, to limit the rotation of the head of the key to one half of a circle, these two functions being ensured by the same device.

The construction of the key, which is both simple and robust, makes it possible to use this type of key with any existing type of lock. Furthermore, this key can be wholly factory made and requires no operation by the retailer, except for the machining of the shank to correspond to a given cylinder.

By simply inverting the colors of the adhesive strip, provided on the center of the body of the key 5, it is possible to use this key both with locks opened by an anticlockwise rotation and those opened by a clockwise rotation.

We claim:

1. A key comprising:

a body having an upper body portion and a lower bitting portion, a head enclosing the upper body with at least one window enabling the viewing of a portion of the upper body of the key, said head being mounted to be rotatable with respect to the upper body of the key and comprising a device limiting the head rotation to one half of a circle, in both directions, and two grooves extending each one over an opposite half of a circumference of the upper body.

2. The key of claim 1, wherein said grooves are ended by a bore, said bore having a depth substantially greater than the depth of said grooves.

3. The key of claim 2, wherein said head further comprises two recesses perpendicular to the longitudinal axis of the key and opening into said grooves and a friction device arranged in each of said recesses.

4. The key of claim 3, wherein said friction devices comprise pins applied into said bores by resilient members.

5. The key of claim 4, wherein said recesses further comprise, at their distal end, an adjustment device making it possible to alter the pressure of said pins against said grooves.

6. The key of claim 1, further comprising an information support indicating two different statuses arranged on a central part of the upper body of the key, said information support comprising a colored self-adhesive strip of two different colors, each color occupying half of the length of said self-adhesive strip and one half of the circumference of said central part of the upper body of the key.

7. The key of claim 1, further comprising an information support indicating two different statuses arranged on a central part of the upper body of the key, said information support comprising a colored bushing of two different colors, each color occupying one half of the circumference of said colored bushing.

8. The key of claim 1, further comprising a shank, wherein the key is designed and adapted to actuate a bolt of a corresponding lock and the torque needed to carry out a rotation of said head relative to said shank, is less than the torque needed to actuate the bolt of the corresponding lock.

* * * * *